US010590741B2

(12) United States Patent
Van Der Veen et al.

(10) Patent No.: US 10,590,741 B2
(45) Date of Patent: Mar. 17, 2020

(54) DUAL BORE CO-MINGLER WITH MULTIPLE POSITION INNER SLEEVE

(71) Applicant: Halliburton Energy Services, Inc., Houston, TX (US)

(72) Inventors: Steffen Van Der Veen, Stavanger (NO); Espen Dahl, Stavanger (NO); Morten Falnes, Sola (NO); Frode Lindland, Sandness (NO)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/073,576

(22) PCT Filed: Mar. 15, 2016

(86) PCT No.: PCT/US2016/022432
§ 371 (c)(1),
(2) Date: Jul. 27, 2018

(87) PCT Pub. No.: WO2017/160278
PCT Pub. Date: Sep. 21, 2017

(65) Prior Publication Data

US 2019/0063187 A1 Feb. 28, 2019

(51) Int. Cl.
*E21B 34/16* (2006.01)
*E21B 41/00* (2006.01)
(Continued)

(52) U.S. Cl.
CPC ..... *E21B 34/16* (2013.01); *E21B 34/14* (2013.01); *E21B 41/0035* (2013.01); *E21B 43/14* (2013.01); *E21B 2034/007* (2013.01)

(58) Field of Classification Search
CPC ..... E21B 34/14; E21B 34/16; E21B 41/0035; E21B 43/14; E21B 23/002
See application file for complete search history.

(56) References Cited

U.S. PATENT DOCUMENTS 5,454,430 A 10/1995 Kennedy et al.
5,906,238 A 5/1999 Carmody et al.
(Continued)

FOREIGN PATENT DOCUMENTS

WO WO 2004/029409 A1 4/2004
WO WO-2015012844 A1 * 1/2015 ..... E21B 23/002

OTHER PUBLICATIONS

International Search Report and the Written Opinion of the International Search Authority, or the Declaration, dated Nov. 25, 2016, PCT/US2016/022432, 16 pages, ISA/KR.

*Primary Examiner* — Giovanna C Wright
*Assistant Examiner* — Dany E Akakpo
(74) *Attorney, Agent, or Firm* — Haynes and Boone, LLP

(57) ABSTRACT

A system for controlling flow and access in multilateral completions is disclosed. The system includes a flow control sub having a single bore portion and a dual bore portion with a sleeve disposed therein. The flow control sub further includes a channel in an inner cylindrical surface, and the sleeve includes protrusions configured to engage the channel, which may be extendable. The channel provides paths for the protrusions between three different positions where two positions allow access to one or the other bore of the dual bore portion and a third position allows flow from both bores of the dual bore portion to co-mingle and enter the flow control sub. A run-in tool may be used to engage the sleeve and apply a pulling or pushing force to move the sleeve along the various channel paths to control flow through the flow control sub.

18 Claims, 8 Drawing Sheets

(51) Int. Cl.

| | |
|---|---|
| ***E21B 43/14*** | (2006.01) |
| ***E21B 34/14*** | (2006.01) |
| *E21B 34/00* | (2006.01) |

(56) References Cited

U.S. PATENT DOCUMENTS

| | | | |
|---|---|---|---|
| 6,009,942 | A | 1/2000 | Williamson |
| 6,227,298 | B1 | 5/2001 | Patel |
| 6,283,216 | B1 | 9/2001 | Ohmer |
| 6,561,277 | B2 | 5/2003 | Algeroy et al. |
| 6,789,628 | B2 | 9/2004 | Hess et al. |
| 7,370,705 | B2 | 5/2008 | Jones et al. |
| 7,565,931 | B2 | 7/2009 | Saucier |
| 7,762,324 | B2 | 7/2010 | Clem |
| 8,037,938 | B2 | 10/2011 | Jardim De Azevedo et al. |
| 8,235,114 | B2 | 8/2012 | Clem et al. |
| 8,397,819 | B2 | 3/2013 | Tunget |
| 8,590,630 | B2 | 11/2013 | Mathiesen et al. |
| 8,596,365 | B2 | 12/2013 | Frosell |
| 8,678,092 | B2 | 3/2014 | Assal et al. |
| 8,826,991 | B2 | 9/2014 | Steele et al. |
| 8,881,824 | B2 | 11/2014 | Stautzenberger |
| 8,931,570 | B2 | 1/2015 | Casciaro et al. |
| 9,091,133 | B2 | 7/2015 | Stewart et al. |
| 2002/0050358 | A1 | 5/2002 | Algeroy et al. |
| 2011/0079388 | A1 | 4/2011 | Cox |

* cited by examiner

DUAL BORE CO-MINGLER WITH MULTIPLE POSITION INNER SLEEVE

PRIORITY

The present application is a U.S. National Stage patent application of International Patent Application No. PCT/US2016/022432, filed on Mar. 15, 2016, the benefit of which is claimed and the disclosure of which is incorporated herein by reference in its entirety.

TECHNICAL FIELD

The present disclosure generally relates to oilfield equipment and, in particular, to downhole tools, systems and techniques for drilling, completing and servicing multilateral wells. More particularly still, the present disclosure relates to systems and methods for selective fluid communication between a primary wellbore and secondary wellbore extending from the primary wellbore.

BACKGROUND

Multilateral wells typically have one or more secondary wellbores, often referred to as branch or lateral wellbores, extending from a primary wellbore, often referred to as a main or parent wellbore. The intersection between a primary wellbore and a secondary wellbore is often referred to as a wellbore junction. Completion equipment positioned at a wellbore junction for controlling fluid communication between the secondary wellbore, the downstream portion of the primary wellbore and the upstream portion of the primary wellbore may also be referred to as a junction. Such fluid communication may involve flow from the well, such as in the case of the production of hydrocarbons from the various wellbores, or may involve flow into the well, such as reservoir stimulation or fracturing during well intervention operations.

Various completion technologies for wellbore junctions provide for fluid communication between a primary and a secondary wellbore, but do not readily permit the flow (either into or out of) each of the wellbores to be varied or combined. Other completion technologies for wellbore junctions provide for varying the rate of fluid flow into or out of a wellbore, but do not permit fluid flow between the wellbores. In certain instances, the entire completion string must be retrieved from the well to establish fluid communication with a secondary wellbore, or with the primary wellbore below the junction.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
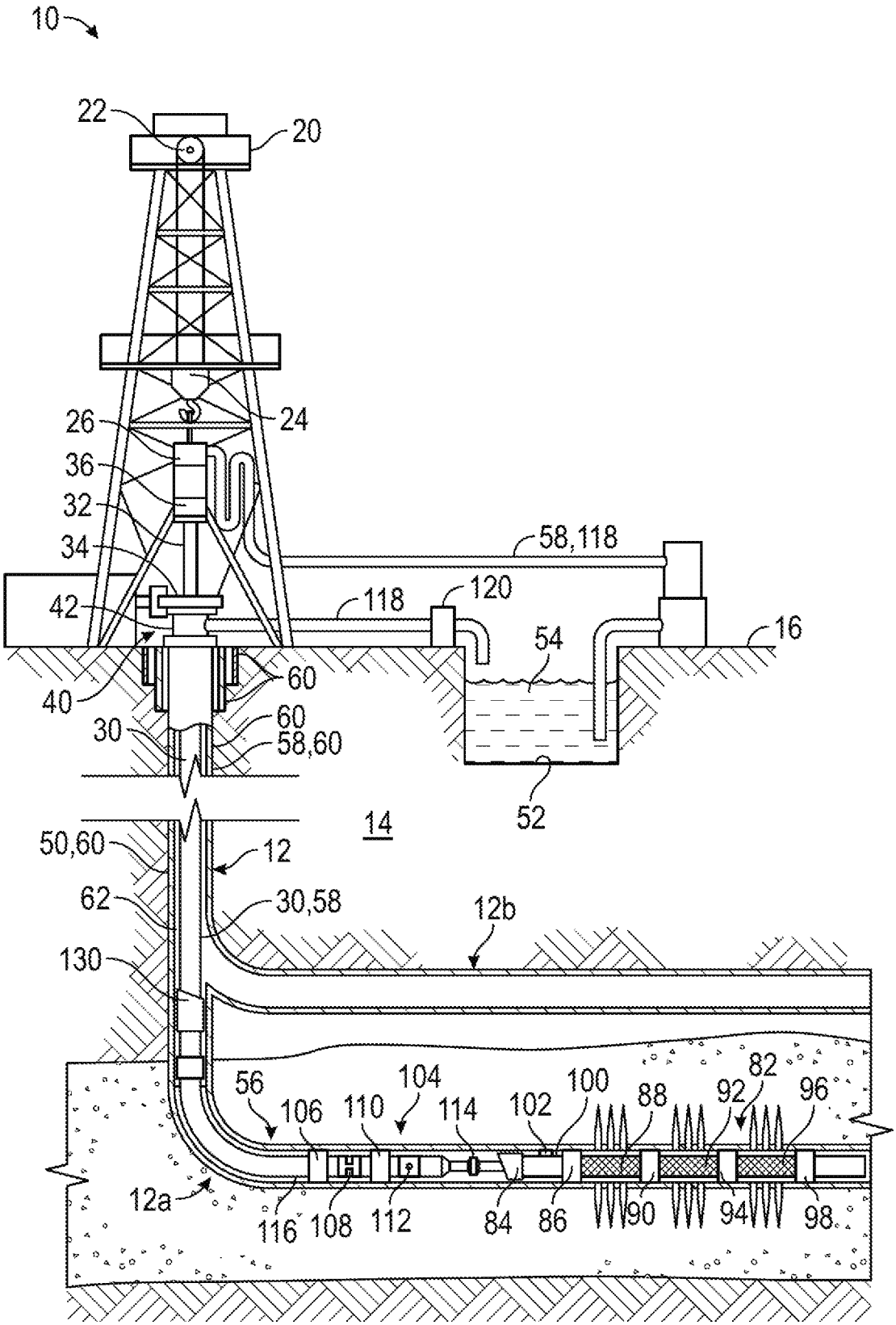
FIG. 1 is an elevation view in partial cross section of a land-based multilateral well system with a flow control system.

The disclosure may repeat reference numerals and/or letters in the various examples or figures. This repetition is for the purpose of simplicity and clarity and does not in itself dictate a relationship between the various embodiments and/or configurations discussed. Unless otherwise stated, spatially relative terms are intended to encompass different orientations of the apparatus in use or operation in addition to the orientation depicted in the figures.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including vertical wellbores, slanted wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa. Further, unless otherwise noted, even though a figure may depict a cased hole, it should be understood by those skilled in the art that the apparatus according to the present disclosure is equally well-suited for use in open hole operations.

Generally, a primary wellbore may refer to any wellbore from which another, intersecting wellbore has been or is to be subsequently drilled, and a secondary wellbore may refer to any subsequently-drilled wellbore extending from (intersecting with) that primary wellbore. The initial wellbore drilled from surface may be the primary wellbore with respect to any one or more intersecting wellbores drilled therefrom, which are the secondary wellbores with respect to that initial wellbore drilled from surface. Each secondary wellbore may then itself be the primary wellbore with respect to any further secondary wellbore(s) drilled therefrom.

As described further below, a multilateral well may be drilled. A flow control system is deployed at a junction in the wellbore where a primary wellbore and a secondary wellbore intersect for controlling fluid communication between the upstream and downstream portion of the primary wellbore and the secondary wellbore. The flow control system may include a flow control sub and a multiple position inner sleeve disposed therein. The flow control sub may have a first and second end with the first end having a single bore and the second end having two bores separately defined and in fluid communication with the single bore. Channels that have been formed along an inner surface of the flow control sub may be disposed opposite and in mirrored fashion from each other. The channels may have been formed directly in an interior surface of the flow control sub or in an additional sub, or the channels may have been formed in an annular sleeve that is inserted into the flow control sub or inserted into an additional sub. The sleeve has first and second ends with an outer sleeve wall extending therebetween and a first and second protrusion, which are disposed in the channels and may be extendable.

The channels may include multiple segments between channel endpoints; the protrusions are movable along the segments of the respective channels. Each channel endpoint may be the terminus of a segment, the intersection of two segments, or a depression in a segment. Endpoints may correspond to sleeve positions; for example, when protrusions are disposed adjacent a first endpoint in the channel, the sleeve second end may be disposed in one of the two bores in flow control sub second end such that sleeve is in fluid communication with only the selected bore. A second endpoint may correspond to the sleeve second end being disposed in the other of the two bores in flow control sub second end such that the sleeve is in fluid communication with only the selected bore. Further, a third endpoint may correspond to the sleeve second end being disposed in the single bore of the flow control sub first end thereby allowing fluids from the two bores in flow control sub second end to mingle in the flow control sub. One or more seals may be disposed between the inner surface of the flow control sub and the outer sleeve wall.

A pushing or pulling force may be applied to the sleeve form the surface to guide the protrusions through the segments oriented in various directions to connect the various endpoints, thereby maneuvering the sleeve from one position or endpoint to another. A run-in tool may be used to engage the sleeve and apply the pushing or pulling force to move the sleeve and control flow through the flow control sub. Depending on the orientation and geometry of the channel segments, an increased pushing or pulling force may be needed to effectuate a transverse motion to move the sleeve in an upward direction whereas a decreased force may be needed due to the effect of gravity. A deeper grooved portion of a channel segment may also be used to control the movement of the protrusions along the channel segments; in particular, at the intersection of two or more segments. When the protrusions reach the intersection of two or more segments, the protrusions expand or extend into the deeper segment portion, which prevents the extendable protrusions from engaging an intersecting segment.

Figure 2:
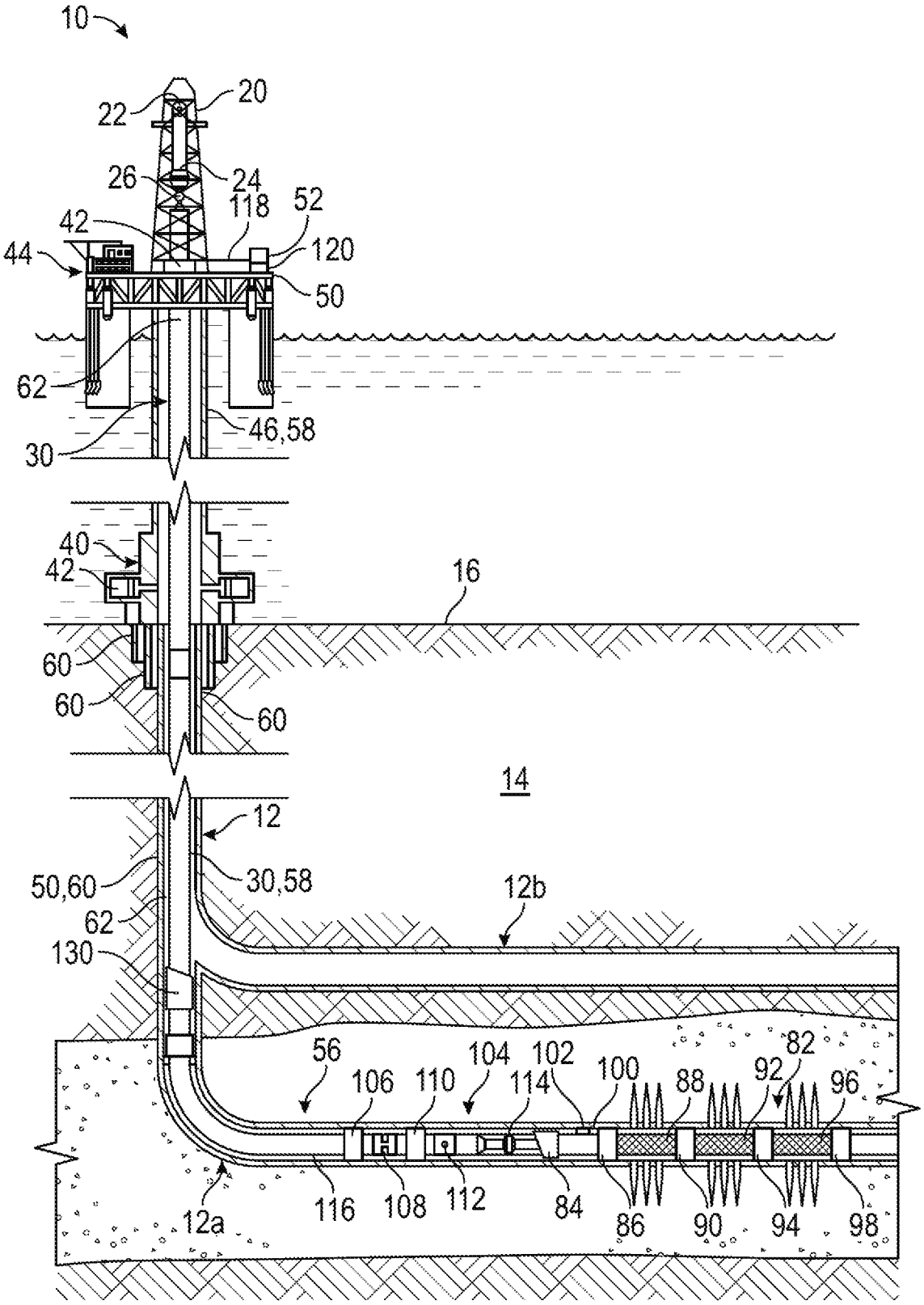
FIG. 2 is an elevation view in partial cross section of a marine-based multilateral well system with a flow control system.

Turning to FIGS. 1 and 2, shown is an elevation view in partial cross-section of a wellbore drilling and production system 10 utilized to produce hydrocarbons from wellbore 12 extending through various earth strata in an oil and gas formation 14 located below the earth's surface 16. Wellbore 12 may be a primary wellbore and may include one or more secondary wellbores 12*a*, 12*b*, . . . 12*n*, extending into the formation 14 and disposed in any orientation and spacing, such as the horizontal secondary wellbores 12*a*, 12*b* illustrated. While generally illustrated as vertical, wellbore 12, as well as any of the other wellbores 12*a*, 12*b*, . . . 12*n* described, may have any orientation.

Drilling and production system 10 may include a rig or derrick 20. Rig 20 may include a hoisting apparatus 22, a travel block 24, and a swivel 26 for raising and lowering casing, liner, drill pipe, work string, coiled tubing, production tubing (including production liner and production casing), and/or other types of pipe or tubing strings collectively referred to herein as tubing string 30, or other types of conveyance vehicles, such as wireline, slickline or cable. In FIGS. 1 and 2, tubing string 30 is a substantially tubular, axially extending work string or production casing, formed of a plurality of pipe joints coupled together end-to-end supporting a completion assembly as described below. Rig 20 may include a kelly 32, a rotary table 34, and other equipment associated with rotation and/or translation of tubing string 30 within a wellbore 12. For some applications, rig 18 may also include a top drive unit 36. Rig 20 is not limited to a particular type of system. In some embodiments, rig 20 may be a drilling rig or a workover rig.

Rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the system 10.

For offshore operations, as shown in FIG. 2, whether drilling or production, rig 20 may be mounted on an oil or gas platform 44, such as the offshore platform as illustrated, semi-submersibles, drill ships, and the like (not shown). System 10 of FIG. 2 is illustrated as being a marine-based production system. Likewise, system 10 of FIG. 1 is illustrated as being a land-based production system. In any event, for marine-based systems, one or more subsea conduits or risers 46 extend from deck 50 of platform 44 to a subsea wellhead 40. Tubing string 30 extends down from rig 20, through subsea conduit 46 and BOP 42 into wellbore 12.

A working or service fluid source 52, such as a storage tank or vessel, may supply a working fluid 54 pumped to the upper end of tubing string 30 and flow through tubing string 30. Working fluid source 52 may supply any fluid utilized in wellbore operations, including without limitation, drilling fluid, cementious slurry, acidizing fluid, liquid water, steam, hydraulic fracturing fluid, propane, nitrogen, carbon dioxide or some other type of fluid.

Wellbore 12 may include subsurface equipment 56 disposed therein, such as, for example, a drill bit and bottom hole assembly (BHA), a work string with tools carried on the work string, a completion string and completion equipment or some other type of wellbore tool or equipment.

Wellbore drilling and production system 10 may generally be characterized as having a pipe system 58. For purposes of this disclosure, pipe system 58 may include casing, risers, tubing, drill strings, completion or production strings, subs, heads or any other pipes, tubes or equipment that attaches to the foregoing, such as string 30 and conduit 46, as well as the primary and secondary wellbores in which the pipes, casing and strings may be deployed. In this regard, pipe system 58 may include one or more casing strings 60 that may be cemented in wellbore 12, such as the surface, intermediate and production casings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

As shown in FIGS. 1 and 2, subsurface equipment 56 is illustrated as completion equipment and tubing string 30 in fluid communication with the completion equipment 56 is illustrated as production tubing 30. Completion equipment 56 is disposed in a substantially horizontal portion of wellbore 12 includes a lower completion assembly 82 having various tools such as an orientation and alignment subassembly 84, a packer 86, a sand control screen assembly 88, a packer 90, a sand control screen assembly 92, a packer 94, a sand control screen assembly 96 and a packer 98.

Extending downhole from lower completion assembly 82 is one or more communication cables 100, such as a sensor cable, electric cable or optic cable, that passes through packers 86, 90, and 94 and is operably associated with one or more electrical devices 102 associated with lower completion assembly 82, such as sensors positioned adjacent sand control screen assemblies 88, 92, 96 or at the sand face of formation 14, or downhole controllers or actuators used to operate downhole tools or fluid flow control devices. Cable 100 may operate as communication media, to transmit power, signals or data and the like between lower completion assembly 82 and an upper completion assembly 104.

In this regard, disposed in wellbore 12 at the lower end of tubing string 30 is an upper completion assembly 104 that includes various tools such as a packer 106, an expansion joint 108, a packer 110, a fluid flow control module 112 and an anchor assembly 114.

Extending uphole from upper completion assembly 104 are one or more communication cables 116, such as a sensor cable, electric cable or optic cable, which passes through packers 106, 110 and extends to the surface 16. Cable 116 may operate as communication media, to transmit power, signals or data and the like between a surface controller (not pictured) and the upper and lower completion assemblies 104, 82, respectively.

Fluids, cuttings and other debris returning to surface 16 from wellbore 12 are directed by a flow line 118 to storage tanks 52 and/or processing systems 120, such as shakers, centrifuges and the like.

In each of FIGS. 1 and 2, a flow control system 200 is shown deployed in wellbore 12 along casing string 30 in the vicinity of a secondary wellbore 12*b*. Although primary wellbore 12 need not be cased for the purposes of the disclosure, in some embodiments, primary wellbore 12, as shown in the figures, may be at least partially cased at the junction with secondary wellbore 12*b*. In any event, flow control system 200 as deployed at the junction between primary wellbore 12 and secondary wellbore 12*b* provides selective fluid communication with and between the wellbores utilizing a dual bore co-mingler sub and a multiple position inner sleeve as described in more detail below.

Figure 3:
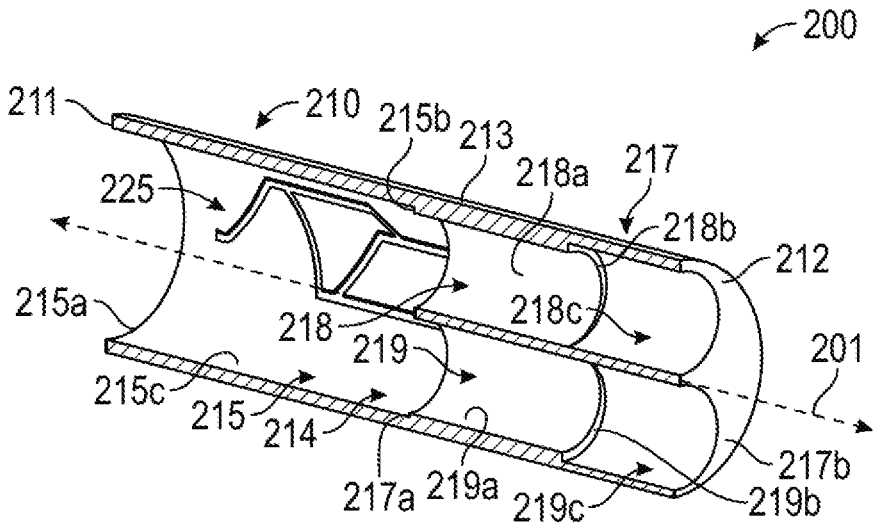
FIG. 3 is an exploded view in partial cross section of an embodiment of a flow control system suitable for use in the flow control systems of FIGS. 1 and 2.
Figure 3:
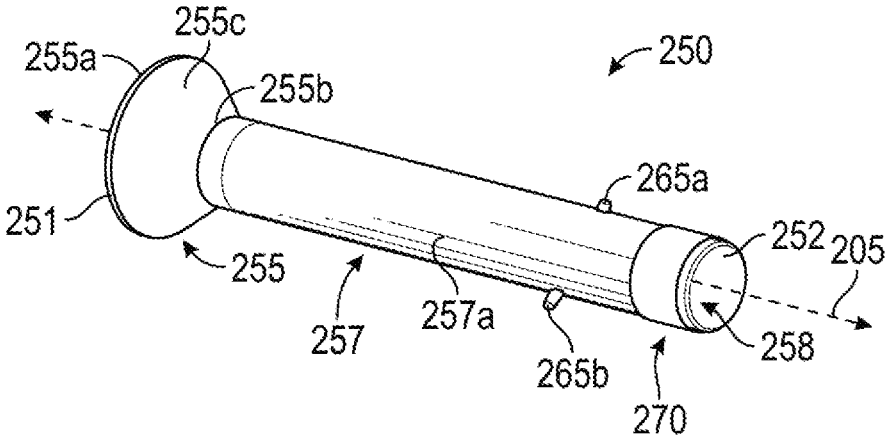

FIG. 3 is an exploded perspective view in partial cross section of flow control system 200. The flow control system 200 includes a main body sub 210 and a tubular sleeve 250. Features of the flow control system 200 may be discussed relative to a central axis 201 of the main body sub 210. The main body sub 210 includes a first section having a first end 211 axially spaced from a second section having a second end 212, and an outer cylindrical surface 213 and an inner cylindrical surface or wall 214 about the central axis 201. Inner cylindrical surface 214 comprises a single bore portion 215 that extends from first end 211 to a dual bore portion 217, which further extends to second end 212. Single bore portion 215 comprises a first end 215*a*, a second end 215*b*, and an inner cylindrical surface 215*c* that extends therebetween, and dual bore portion 217 comprises a first end 217*a*, a second end 217*b*, and a first through bore 218 adjacent a second through bore 219, extending between first and second ends 217*a*, 217*b*, respectively, and spaced apart from one another. In one or more embodiments, bores 218, 219 are parallel to central axis 201 and may be formed in an otherwise solid tubular section. Single bore first end 215*a* is coincident with main body first end 211 and dual bore second end is coincident with main body second end 212. In one or more embodiments, first and second through bore 218, 219, respectively, each have a small diameter cylindrical surface 218*a*, 219*a*, respectively, that extends from dual bore portion first end 217*a* to an internal shoulder 218*b*, 219*b*, respectively, and an expanded diameter cylindrical surface 218*c*, 219*c* that extends from internal shoulder 218*b*, 219*b* to dual bore portion second end 217*b*.

Figure 4:
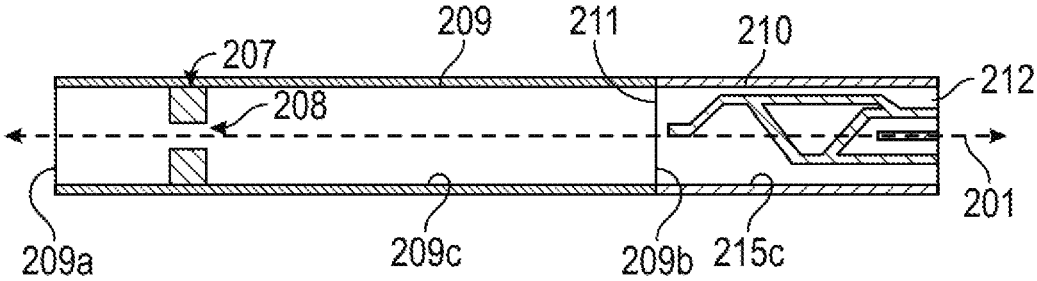
FIG. 4 is a side view in partial cross section of a flow control sub of the flow control system shown in FIG. 3.
Figure 12:
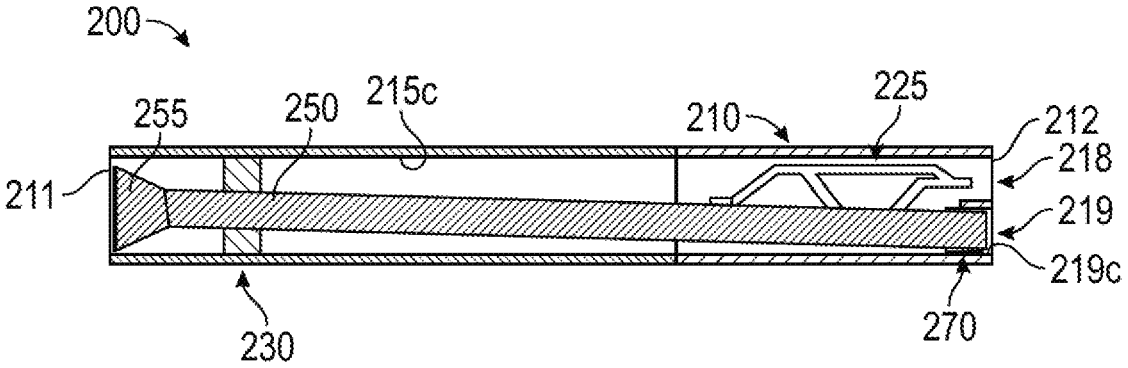

FIG. 4 is a cross-sectional side view of an additional sub 209 coupled to and in communication with main body first end 211. The additional sub 209 is cylindrical with a central axis coincident with main body central axis 201, and comprises a first end 209*a* opposite a second end 209*b* and an inner cylindrical surface 209*c* in fluid communication with single bore inner cylindrical surface 215*c* of main body sub 210. In one or more embodiments, additional sub 209 is longer than main body sub 210. Thus, main body sub 210 may have a first axial length between first and second ends 211, 212, respectively, while additional sub 209 has a second axial length, greater than the first axial length, between its first and second ends 209*a*, 209*b*, respectively. Additional sub 209 further includes an annular seal 207 disposed along inner cylindrical surface 209*c* and having an aperture 208 proximate central axis 201. Seal 207 sealingly engages surface 209*c*. Seal 207 may be comprised of any suitable seal or seals known in the art including, but not limited to, elastomeric elements, O-rings and T-seals. The first end 209*a* of the additional sub is further configured to couple to additional subs (not shown) with threads or other suitable fasteners standard in the art. In an embodiment, main body sub 210 and additional sub 209 are integrally formed, as shown in FIG. 12. In the following description, the main body sub 210 will be described as including additional sub 209.

Figure 5:
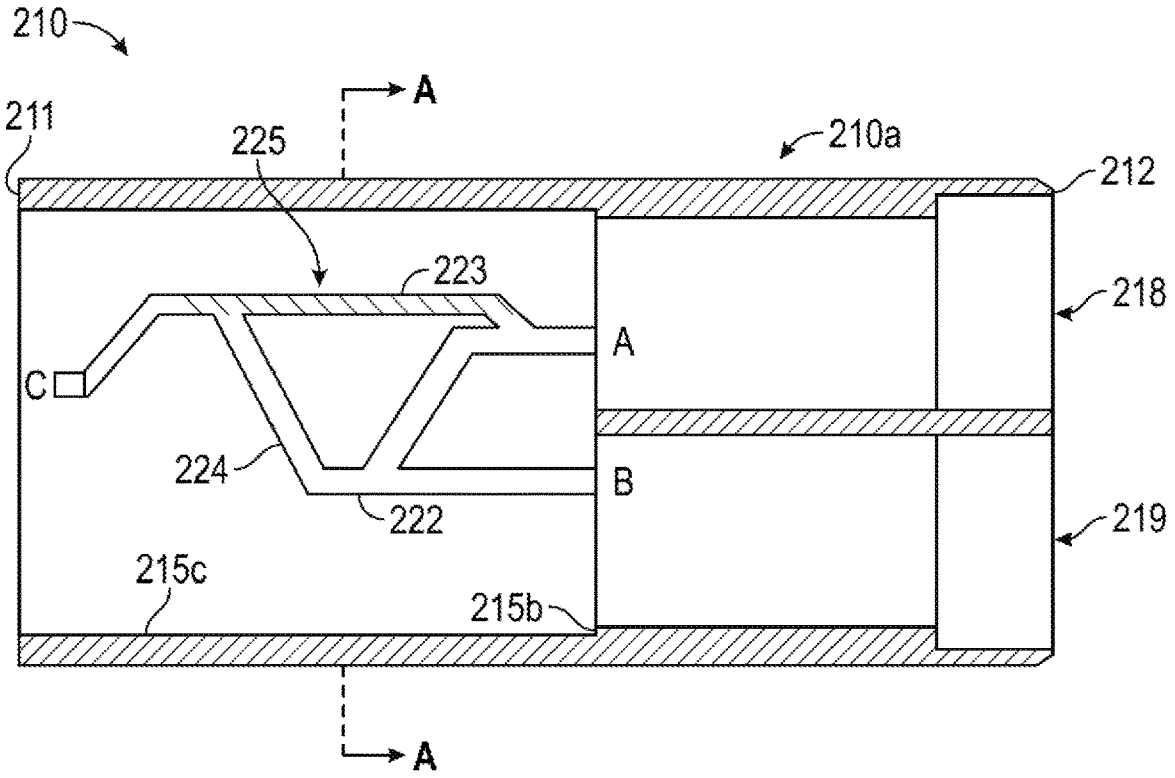
FIG. 5 is a close-up side view in partial cross section of a portion of the flow control sub shown in FIG. 3.

Referring now to FIG. 5, shown is a side view of the main body sub 210 in cross section. The single bore inner cylindrical surface 215*c* further includes a channel or groove 225 comprising two or more endpoints, such as endpoints A, B, C, connected by path portions or segments 224, with segments interconnected to form paths as described below. In one or more embodiments, channel 225 is comprised of a plurality of segments 224 that intersect one another to form channel 225.

In this regard, an endpoint may be the terminus of a segment 224, the intersection of two segments, or a depression or cavity formed along a segment. As will be appreciated in the description of the operation below, the segments may have different orientations, such as a horizontal segment, a forward sloping segment or a backward sloping segment. In addition, various segments 224 or portions of segments may have differing channel depths, such a first depth that is less than a second depth. For example, the hatched portion of channel 225 shown in FIG. 5 may be formed to be deeper or have an increased depth relative to other segments of the channel 225. Likewise, an endpoint may have a different depth, either shallower or deeper, than the segment along which the endpoint is defined.

Figure 6:
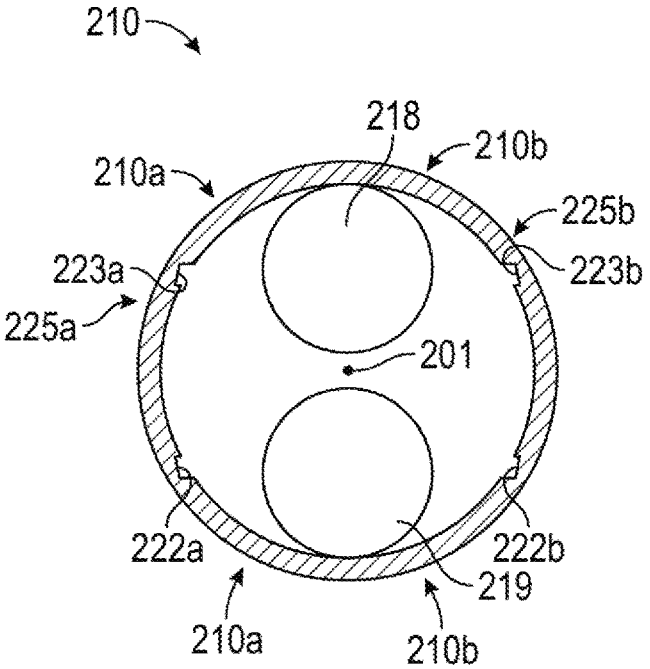
FIG. 6 is a front view in cross-section A-A of the flow control sub shown in FIG. 5.

One embodiment of channel 225 with interconnected path segments 222, 223, 224 is shown in FIG. 5, and a cross section of the main body sub 210 with path segments 222, 223 is shown in FIG. 6; the approximate location of the cross section shown in FIG. 6 is represented by line A-A in FIG. 5. In one or more embodiments, a first channel 225*a* is formed in cylindrical surface 215*c* and a second channel (not shown) is formed in cylindrical surface 215*c*. FIG. 5 is shown in cross section and illustrates a section 210*a* of main body sub 210, it will be appreciated that in one or more embodiments, in the opposing section 210*b* of main body sub 210 (shown in FIG. 6), a second channel or groove 225*b*

(FIG. 6) disposed opposite from and mirroring the first channel 225*a* may be provided, such that the first and second channels 225*a*, 225*b*, respectively, are aligned with one another. In particular, first path segment 223*a* of first channel 225*a* is disposed opposite from and mirroring a first path segment 223*b* of second channel 225*b*. Second path segments 222*a*, 222*b*, of the first and second channels 225*a*, 225*b*, respectively are similarly disposed opposite from and mirroring one another. In other embodiments, the path segments 222, 223, 224 of channel 225 may be configured in different patterns. In one or more embodiments, a second channel 225*b* may be disposed opposite the first channel 225*a* in a mirrored or matching pattern. In other embodiments, channel 225 may be configured in different geometries that are simpler or more complex with additional path segments 222, 223, 224 formed of varying lengths and configured in different directions with various angles of intercept. For example, in other embodiments, there may be only two endpoints (e.g., A and B; A and C; or B and C) instead of three (A, B, C). In the present embodiment, the channels 225 are formed directly in the inner cylindrical surface 215*c* of main body sub 210; however, in other embodiments, channels 225 may be formed in an annular sleeve that is then inserted into the main body sub 210, may be formed in additional sub 209, or formed in an annular sleeve that in then inserted into the additional sub 209. It will be appreciated that while channel 225 is illustrated in proximity to second end 215*b*, channel 225 may be defined anywhere along single bore portion 215 between first end 215*a* and second end 215*b*. In this same vein, endpoints A and B of channel 225 need not be adjacent first and second through bore 218, 219, respectively, but may be spaced apart therefrom.

Figure 7:
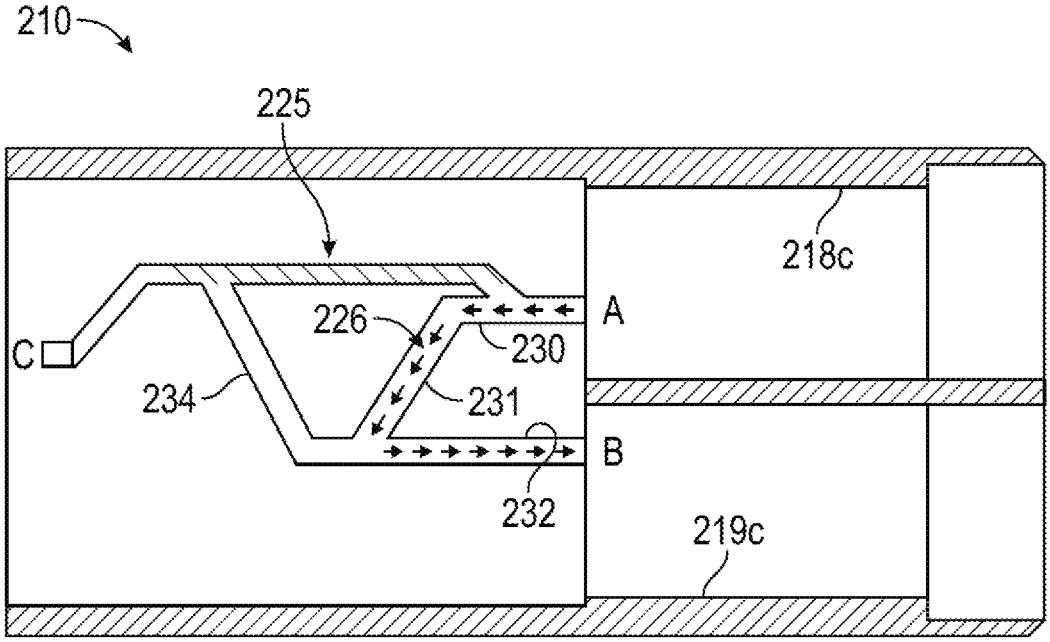
FIG. 7-10 are side views in partial cross section of the flow control sub of FIG. 5 showing various paths of a guiding profile.
Figure 8:
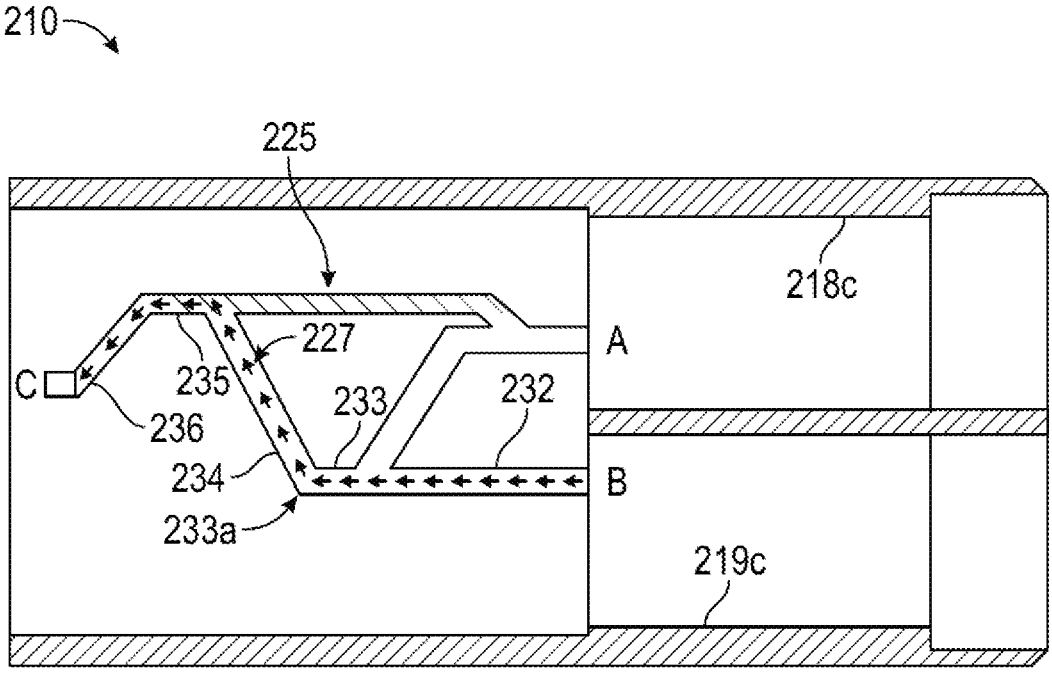
Figure 9:
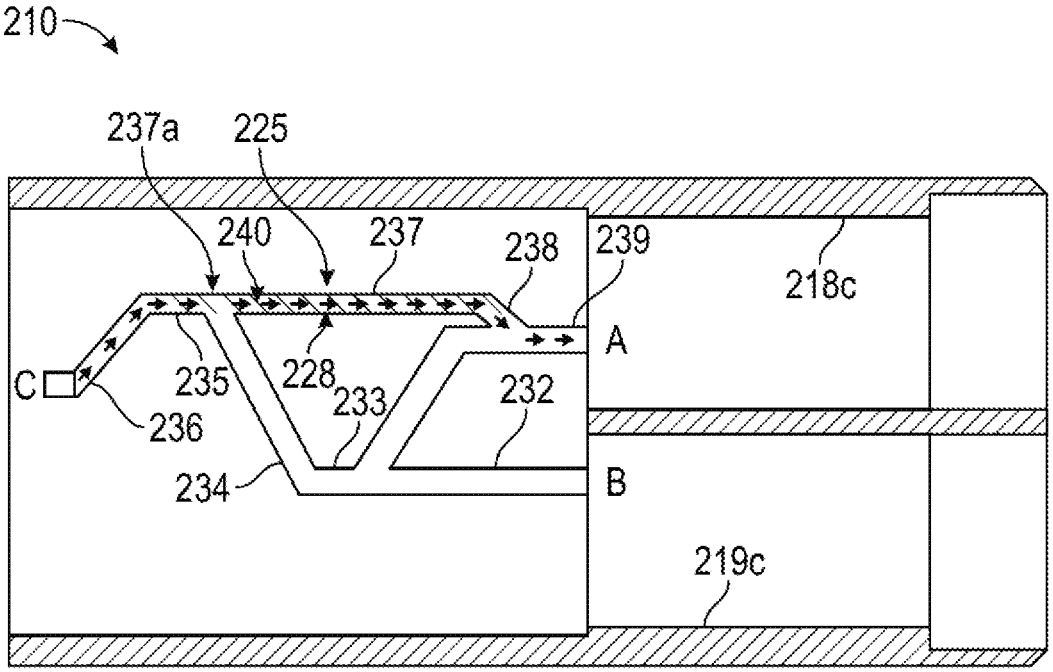
Figure 10:
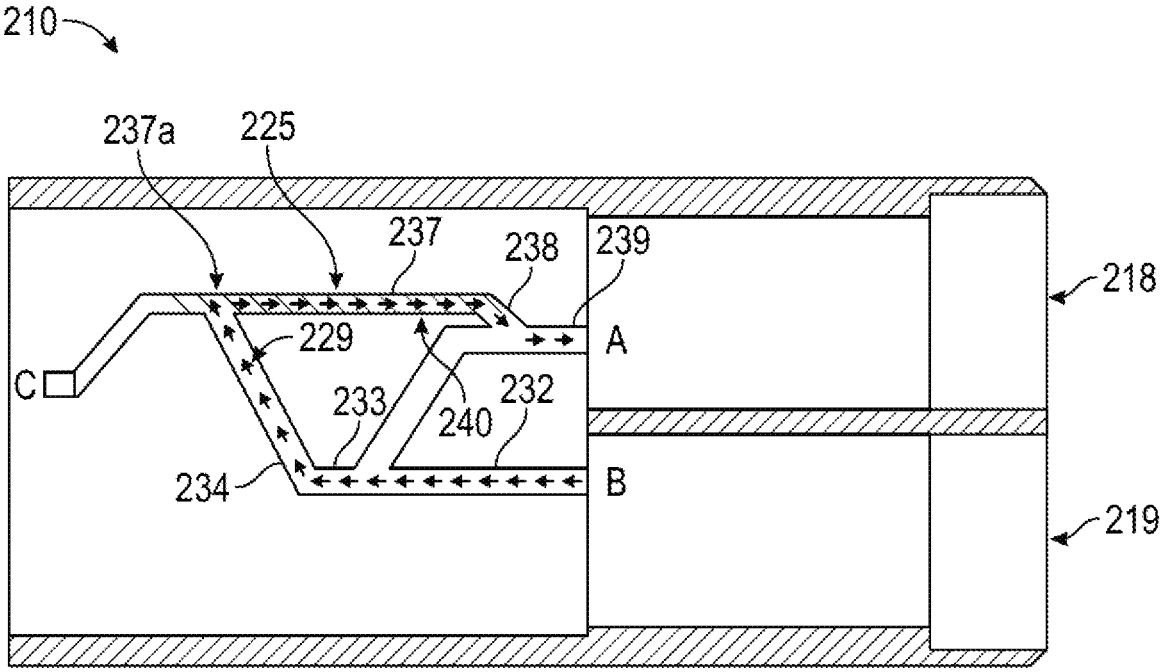

Referring now to FIGS. 7-10, shown is the side view of main body sub 210 in cross section of FIG. 5 with various paths marked through channel 225. In particular, FIG. 7 shows a path 226 from A to B; FIG. 8 shows a path 227 from B to C; FIG. 9 shows a path 228 from C to A; and FIG. 10 shows a path 229 from B to A. These paths 226, 227, 228, 229 will be described in further detail below.

Referring again to FIG. 3, tubular sleeve 250 comprises a central axis 205, a first end 251, a second end 252, a cylindrical portion 257, and a through bore 258. In one or more embodiments, sleeve 250 may further comprise a frustoconical portion or scoophead 255. Scoophead 255 includes a first end 255*a* coincident with sleeve first end 251, a second end 255*b*, a frustoconical surface 255*c* extending therebetween, and a through bore 256 in fluid communication with the cylindrical portion through bore 258. Frustoconical surface 255*c* extends from first end 255*a* radially inward toward central axis 205 and axially to second end 255*b*. Cylindrical portion 257 has an outer cylindrical surface 257*a* that extends from frustoconical portion second end 255*b* to sleeve second end 252. Scoophead may be made from a flexible material or any other suitable material known in the art. A protrusion 265 is disposed along outer cylindrical surface 257*a*. In one or more embodiments, sleeve 250 includes first and second protrusions 265*a*, 265*b*, respectively, disposed radially opposite one another on cylindrical portion 257 and spaced away from sleeve second end 252. In one or more embodiments, protrusions 265*a*, 265*b* extend radially outward from cylindrical portion 257 and are configured to move radially inward and outward in response to an external structure. Follower or protrusion 265 may include, for example, retractable lugs and spring plungers. Extendable protrusion 265 is sized to engage and move within channel 225 as described below. In the present embodiment, extendable protrusions 265*a*, 265*b* are retractable lugs. Retractable lugs 265*a*, 265*b* extend radially beyond outer cylindrical surface 257*c* a predetermined minimum distance such that even in a fully retracted position, retractable lugs 265*a*, 265*b* still extend radially beyond outer cylindrical surface 257*c*. Further, disposed proximate sleeve second end 252 is a seal 270. Seal 270 may be comprised of any suitable seal or seals known in the art including, but not limited to, an elastomeric element, O-rings and T-seals.

Figure 11:
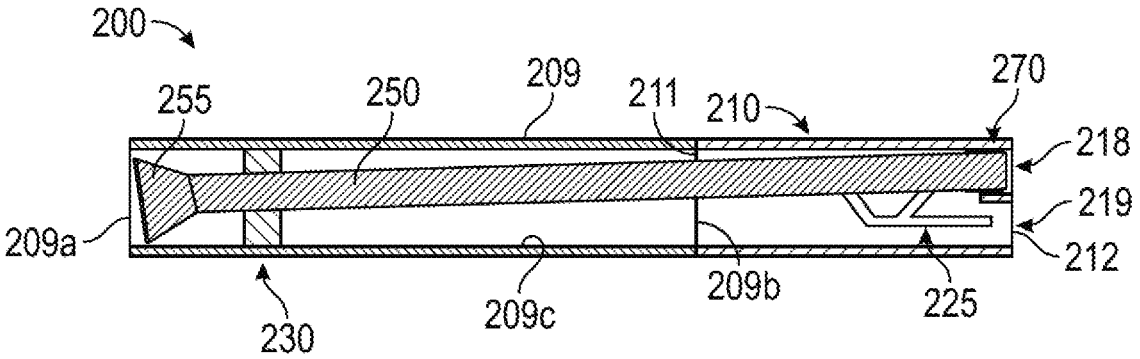
FIGS. 11-13 are side views in partial cross section of the system of FIG. 3 with a sleeve disposed in various positions in the flow control sub.
Figure 13:
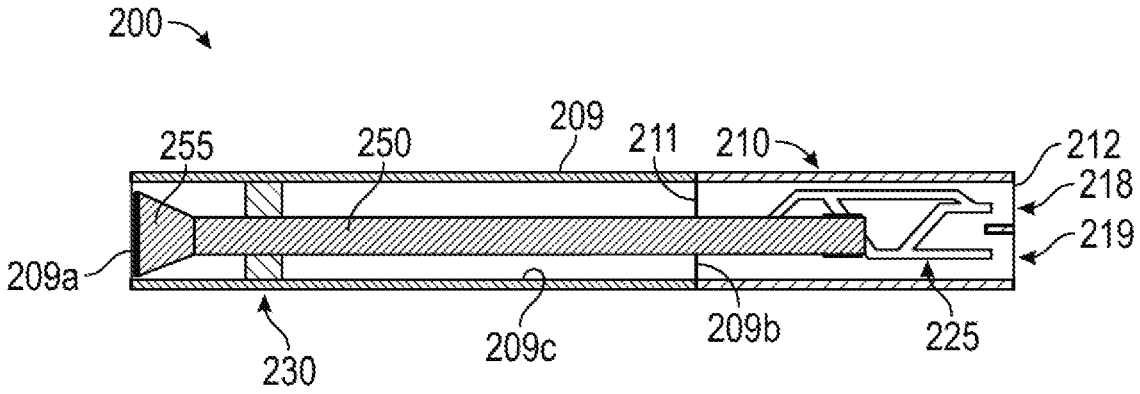

Referring now to FIGS. 11-13, shown are side views in partial cross section of the main body sub 210 and additional sub 209 of FIG. 4 with sleeve 250 disposed therein in various positions. Sleeve 250 is disposed in main body sub 210 and additional sub 209 such that scoophead 255 of sleeve 250 is disposed on one side of the seal 207 proximate additional sub first end 209*a* and the sleeve second end 252 is disposed on the other side of seal 207 proximate main body second end 212. In particular, seal 207 is configured to allow cylindrical portion 257 of sleeve 250 to pass sealingly there through while also providing a seal against inner cylindrical surface 209*c*. Further, sleeve 250 is positioned in main body sub 210 and sub 209 such that retractable protrusion 265 is sized to fit in channel 225. To the extent first and second channels 225*a*, 225*b*, respectively, are defined, then first and second retractable protrusions 265*a*, 265*b*, respectively, are likewise provided and each disposed to extend into a corresponding channel 225*a*, 225*b*, respectively (see FIG. 6). As the retractable lugs 265*a*, 265*b* are urged through first and second channels 225*a*, 225*b*, respectively, concurrently, sleeve second end 252 is guided to various positions in single bore portion 215 and dual bore portion 217 of main body sub 210. Thus, the first and second channels 225*a*, 225*b*, respectively, form a guiding profile for sleeve 250.

Referring again to FIG. 5, in the present embodiment, sleeve 250 may be maneuvered into one of three positions: position A, position B, or position C. Operation will be described with two channels 225 and two retractable protrusions 265. When sleeve 250 is in position A, retractable lugs 265*a*, 265*b* are located adjacent endpoint A in guiding profile 225 and sleeve second end 252 is disposed in first through bore 218 of main body sub 210 (see FIG. 11) so that sleeve 250 is in fluid communication only with first through bore 218; when sleeve 250 is in position B, retractable lugs 265*a*, 265*b* are located adjacent endpoint B and sleeve second end 252 is disposed in second through bore 219 of main body sub 210 (FIG. 12) so that sleeve 250 is in fluid communication only with second through bore 219; and when sleeve 250 is in position C, retractable lugs 265*a*, 265*b* are located adjacent endpoint C and sleeve second end 252 is disposed in single bore portion 215 (FIG. 13) spaced apart from bores 218, 219 so that sleeve 250 is in fluid communication with both first and second through bores 218, 219. It will be appreciated that in position C, flow from bores 218, 219 can comingle, while in positions A and B, flow into and out of through bores 218, 219, respectively, is isolated. Sleeve 250 may be preinstalled in main body sub 210 before system 200 is run-in and positioned in a wellbore 12. In this regard, sleeve 250 may be in one of two positions—position A or position B—before system 200 is installed downhole; the preinstalled position is determined based on which wellbore will be subject to downhole operations first (i.e., the wellbore in fluid communication with first through bore 218 or the wellbore in fluid communication with second through bore 219. By having the sleeve 250 preinstalled in one of the first and second through bores 218, 219, respectively, in dual bore portion 217, work can be performed and the sleeve 250 can then be shifted to the other bore without having to trip system 200 out of wellbore 12. In the present embodiment, sleeve 250 is preinstalled in position A (FIG. 11); however, in other embodiments, sleeve 250 may be preinstalled in position B (FIG. 12). In yet further embodiments, it may be desired to allow mingling of fluid from the first and second through bore 218, 219, respectively, before any work is performed in either through bore 218, 219, in which case, the sleeve 250 will be preinstalled in position C (FIG. 13).

While the flow control system 200 described herein is not limited to use in a wellbore of a particular orientation, in one or more embodiments, flow control system 200 may be deployed in a substantially horizontal primary wellbore that has one or more secondary wellbores intersecting therewith. The following descriptions of operation are but one embodiment of the operation of flow control system 200. In the following operational embodiments, flow control system 200 is deployed in a substantially horizontal wellbore such that the horizontal portion of the wellbore has one side "above" the other side for purposes of orientation. Referring now to FIGS. 7-10, sleeve 250 may be maneuvered reciprocatingly via retractable lugs 265 through the various paths 226, 227, 228, 229 between endpoints A, B, C in main body sub 210. In one or more embodiments, a run-in tool (not shown) that engages sleeve 250 may be used to apply the pushing (down wellbore) or pulling (up wellbore) force necessary to guide sleeve 250 along a segment of channel 225. The run-in tool may be any tool known in the art and may be carried on any type of deployment vehicle, including but not limited to, drill pipe, production tubing, coiled tubing, slick line, and wireline.

In any event, when the sleeve 250 is installed in main body sub 210 in position A (see FIGS. 5 and 11), second through bore 219 is isolated from upstream fluid communication while allowing upstream fluid communication with first through bore 218. When the desired operation requiring selective fluid communication with first through bore 218 (and any secondary or lateral wellbore in communication therewith) is completed, sleeve 250 can be adjusted to a different position, i.e., position B or C for additional operations. In other words, the sleeve 250 is moved from position A (FIG. 11) to position B (FIG. 12) by manipulating sleeve 250 so that retractable lugs 265*a*, 265*b* of sleeve 250 are guided along path 226 shown in FIG. 7. In particular, a force is applied to pull sleeve 250 along path 226 such that retractable lugs travel axially along segment 230 of path 226 until lugs 265 reach segment 231, where gravity or a continued pulling force causes lugs 265 to then travel along segment 231. Lugs 265 will then reach segment 232 and continue to be pulled until the lugs 265 reach segment 234. At this point, to move lugs 265 along segment 234 in an upward direction, a significant increase in the pulling force would be needed. Thus, operators at the surface would understand that lugs 265 were positioned at the junction of segment 234 and segment 232. In other words, under an upward pulling force sleeve 250 will be unable to be pulled any further without a transverse motion to lift the sleeve 250 up, such motion occurring only under a significantly increased pulling force. Rather, sleeve 250 may be pushed further downhole, moving lugs 265 axially along segment 232 until the lugs 265 reach endpoint B and sleeve 250 seats in bore 219. In such case, seal 270 engages expanded diameter cylindrical surface 219*c* of second through bore 219 as shown in FIG. 12.

To the extent it is desired to establish fluid communication with both through bores 218, 219, the sleeve 250 may be moved to position C (see FIG. 13). With respect to fluid flow from the well 12, this position C allows flow from both the first and second through bores 218, 219, respectively, to co-mingle and enter single bore portion 215 of main body sub 210. As an example, to move sleeve 250 from position B (FIG. 12) to position C (FIG. 13), retractable lugs 265 of sleeve 250 are guided along path 227 shown in FIG. 8 by pulling sleeve 250 along path 227 such that retractable lugs 265 travel axially along segments 232 and 233 of path 227 until lugs 265 reach the intersection 233*a* of segments 233 and 234. As previously discussed, an appreciable increase in the upstream pulling force applied to sleeve 250 is necessary to effectuate a transverse motion to move the sleeve 250 in an upward direction along segment 234. At the point where lugs 265 reach the intersection of segments 234 and 235, the pulling force necessary to continue to move sleeve 250 along channel 227, and in particular, segment 235, will decrease. Likewise, because of the effect of gravity as the lugs 265 are guided along segment 236, the pulling force will decrease even more as sleeve 250 is moved along path 227 toward endpoint C as shown in FIG. 13.

Referring now to FIG. 9, shown is main body sub 210 with arrows indicating a path 228 from endpoint C to endpoint A along channel 225. When it is desired to move the sleeve 250 into position A from endpoint C, the downward (or pushing) applied force must be increased to urge sleeve 250 in an upward direction along segment 236 until lugs 265 reach segment 237, at which point, resistance will decrease (and hence the force necessary to urge sleeve 250 along segment 237). Continued application of downward force (or pushing force) will urge sleeve 250 along segment 237 until the intersection with segment 238 is reached, at which point, resistance to the downward force will again decrease as sleeve 250 moves along segment 238. Finally, continued application of a downward force with urge sleeve 250 along segment 239 until endpoint A is reached.

In one or more embodiments, it will be appreciated that when lugs 265 of sleeve 250 reach the intersection 237*a* of segments 234 and 237, gravity would normally cause the lugs 265 to engage segment 234 as opposed to continuing along segment 237. To prevent this downward movement, a portion of guiding profile 225 is configured to have a deeper groove 240 (hatched portion in segment 237) than the remaining guiding profile 225 such that when lugs 265 reach the intersection 237*a*, the retractable lugs 265 will expand into the deeper groove 240 in segment 237 and prevent the sleeve 250 from engaging segment 234. In one or more embodiments, the deeper groove 240 begins before intersection 237*a* and extends along segment 237 to a point past intersection 237*a* such that a shoulder formed at the intersection of the two segments 237, 234 prevents lugs 265 from engaging segment 234. In other embodiments, and depending on the desired preinstalled position of sleeve 250 and geometry of the guiding profile 225, the deeper groove portion 240 may be located in another segment. In this regard, deeper groove portion 240 is generally positioned anywhere along channel 225 to prevent the retractable lugs 265 from engaging an intersecting segment. This is particularly desirable where gravity may otherwise urge lugs 265 to engage the intersecting segment.

Referring now to FIG. 10, shown is main body sub 210 with arrows indicating a path 229 from endpoint B to endpoint A along channel 225. It may be desired to move sleeve 250 from position B to position A. In particular, to move the sleeve 250 from position B (FIG. 12) to position A (FIG. 11) the retractable lugs 265 of sleeve 250 are guided along path 229 shown in FIG. 10 by pulling sleeve 250 along path 229 such that retractable lugs travel axially along segments 232 and 233 of path 229 until lugs 265 reach the intersection 233*a* of segments 233 and 234. As previously discussed, an appreciable increase in upstream pulling force applied to sleeve 250 is necessary to effectuate a transverse motion to move the sleeve 250 in an upward direction along segment 234. When lugs 265 reach the intersection 237*a* of segments 234 and 237, the retractable lugs 265 will expand into the deeper groove 240 in segment 237 and prevent the sleeve 250 from reengaging segment 234. The pushing force will decrease because of the effect of gravity as the lugs 265 are guided along segment 238. Once lugs 265 reach endpoint A, seal 270 engages expanded diameter cylindrical surface 218*c* of first through bore 218 as shown in FIG. 11.

Guiding profile 225 with retractable lugs 265 on sleeve 250 allow the sleeve 250 to maneuver between positions A, B, and C as many times as needed or desired without having to trip system 200 out of wellbore 12. Combinations of the previously described paths 226, 227, 228, 229 may also be used to maneuver the sleeve 250 from position A to position C or from position C to position B. For example, segments 230, 231 of path 226 (FIG. 7) may be combined with segments 233, 234, 235, 236 of path 227 (FIG. 8) to move sleeve 250 from position A to position C. Similarly, segments 236, 235, 237, 238 of path 228 (FIG. 9) may be combined with segments 230, 231, 232 of path 226 (FIG. 7) to move sleeve 250 from position C to position B.

As previously discussed, in other embodiments, channel 225 may be configured in different geometries that are simpler or more complex. For example, if only one movement is needed, such as from position A to position B and no other movement thereafter is needed, guiding profile 225 need only comprise segments 230, 231, 232 that make up path 226. Guiding profile 225 may further be configured to provide one path and allow only one cycle or movement of the sleeve 250. Additionally, where guiding profile 225 comprises one path, protrusions 265 disposed in guiding profile 225 may, but need not, be extendable.

In the present embodiment, system 200 is installed in a horizontal well; however, in other embodiments, system 200 may be installed in a well with an inclination where the guiding profile 225 will be relied on solely for maneuvering sleeve 250 between positions A, B, C without gravity affecting the lugs 265 as they move through guiding profile 225.

Figure 14:
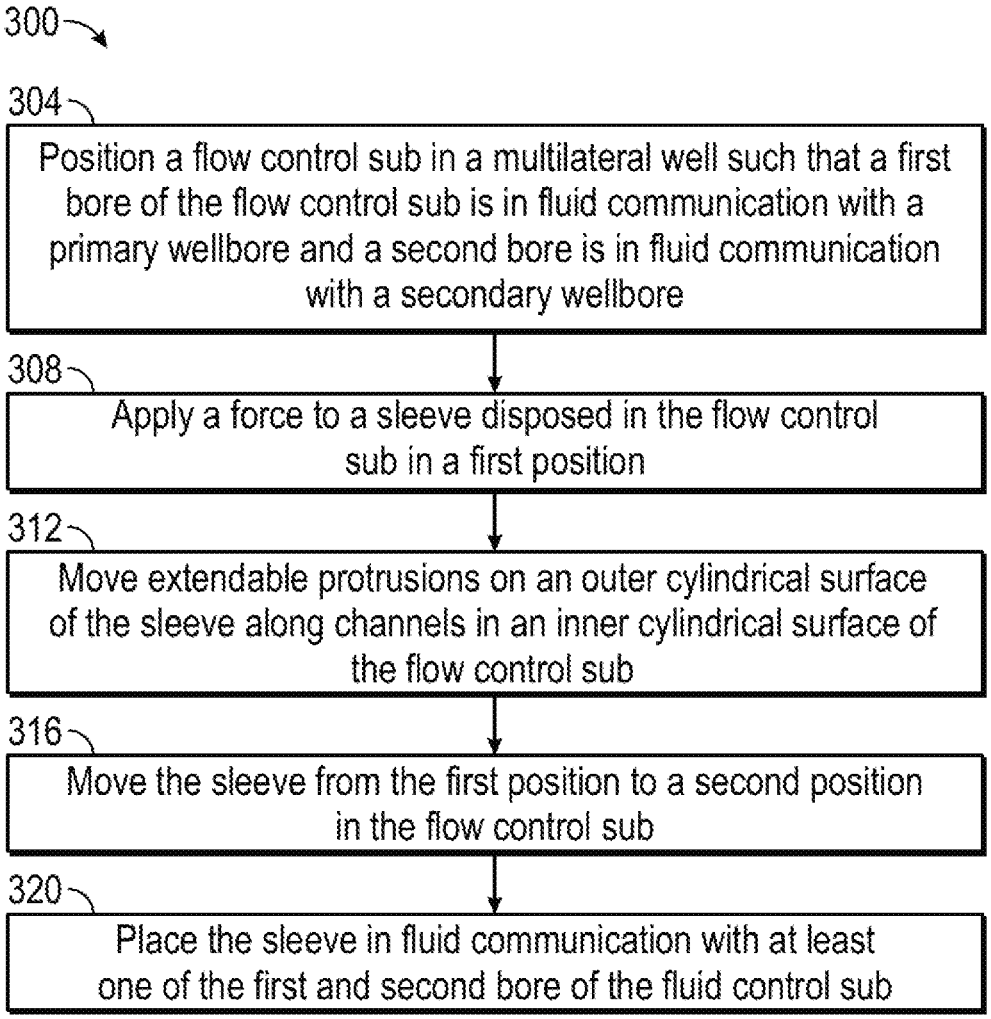
FIG. 14 is a flowchart of a method for controlling flow with the flow control sub of FIG. 5.

Referring now to FIG. 14 and with reference to FIGS. 1 through 13, exemplary embodiments of an operational procedure 300 for controlling flow in a wellbore 12 are described that employ the flow control system 200 described above. Initially, at step 304, the flow control sub 210 is positioned in a well 12 such that first through bore 218 of the flow control sub 210 is in fluid communication with a primary wellbore 12 and second through bore 219 is in fluid communication with a secondary wellbore 12*n*. At step 308, a force is applied to sleeve 250, which is disposed in the flow control sub 210 in a first position. The applied force may be in the form of pushing (down wellbore) or pulling (up wellbore) the sleeve, and may also include the effects of gravity. Further, when in the first position, the sleeve 250 may be disposed in flow control sub 210 such that sleeve 250 is placed in fluid communication with only the primary wellbore via first through bore 218, only the secondary wellbore via second through bore 219, or both the primary and secondary wellbores. Further still, one or more seals 230, 270 may be disposed between the sleeve 250 and the flow control sub 210.

At step 312, extendable protrusions 265 disposed proximate one end 252 of the sleeve 250 on outer surface 257*a* are moved along channels 225 in inner surface 215*c* of the flow control sub 210. Channels 225 comprise a first and second channel 225*a*, 225*b* disposed opposite from and mirroring each other; each channel 225*a*, 225*b* further comprises a plurality of interconnected segments 224 that may have different orientations and depths and may intersect one another. Extendable protrusions 265*a*, 265*b* extend into and move along channels 225*a*, 225*b*, respectively, as the sleeve 250 undergoes any pushing, pulling, or transverse motions, any of which may also be impacted by gravity, or any combination thereof (step 308). Moreover, the movement of the extendable protrusions 265 through the channels 225 can be controlled by deepening a portion of channel 225. When the extendable protrusions 265 reach a deeper channel 225 portion, the extendable protrusions 265 expand into the deeper groove 237, which allows the extendable protrusions 265 to resist gravity and prevent protrusions 265 from entering any intersecting channel segments.

At step 316, the sleeve 250 is moved from the first position to a second position in the flow control sub 210; and at step 320, the sleeve 250 is placed in fluid communication with at least one of the first and second bores 218, 219, respectively, of the fluid control sub 210. In particular, when in the second position, the sleeve 250 may be disposed in flow control sub 210 such that sleeve 250 is placed in fluid communication with only the primary wellbore via first through bore 218, only the secondary wellbore via second through bore 219, or both the primary and secondary wellbores. Further, when sleeve 250 is placed in fluid communication with one of the first and second bores 218, 219, respectively, flow through one of the first and second bores 218, 219, respectively, of the flow control sub 210 is in upstream fluid communication, while flow through the other of the first and second bores 218, 219, respectively, of the flow control sub 210 is isolated from upstream fluid communication. The sleeve 250 may be further moved to a third position in the flow control sub 210, in which flow through the first and second bores 218, 219 of the flow control sub 210 is allowed to mingle in the flow control sub 210 and is in upstream fluid communication.

Thus, a flow control system has been described. Embodiments of the flow control system for oil and gas wells may generally include a main body sub, having a first section with a single bore, and a second section with two adjacent through bores in fluid communication with the single bore of the first section, a guide channel along an inner wall of the single bore, and a sleeve having a through bore is movably positionable in the main body with a protrusion on the sleeve riding in the guide channel to guide reciprocating movement of the sleeve within the main body. Other embodiments of a flow control system for oil and gas wells may generally include a main body sub having first and second ends, the main body first end having a single bore formed therein, the single bore defined by a wall having an inner surface, the single bore in fluid communication with two through bores separately defined in the main body second end; a channel formed along the inner surface; and a sleeve disposed in the main body, the sleeve having a first end and a second end with an outer sleeve wall extending therebetween, the sleeve further including a protrusion, which may be extendable, disposed along the outer sleeve surface and seated in the channel. Likewise, a system for controlling fluid flow in multilateral wellbore completions may generally include a flow control sub having a first bore in a first section in fluid communication with a second and third bore in a second section, a primary wellbore tubular in fluid communication with one of the second and third bores, a secondary wellbore tubular in fluid communication with the other of the second and third bores, a sleeve having a through bore disposed in the flow control sub with a first and second retractable lug, and a guiding channel having at least three interconnected endpoints, the channel disposed in an inner wall of the flow control sub, wherein the first and second retractable lugs are disposed in the guiding channel. Other embodiments of a system for controlling fluid flow in multilateral wellbore completions may generally include a primary wellbore tubular; a secondary wellbore tubular; a flow control sub having a first bore at a first end and a second and third bore at a second end, the first bore being in fluid communication with the second and third bores, one of the second or third bores being in fluid communication with the primary wellbore tubular and the other of the second or third bores being in fluid communication with the secondary wellbore tubular; a sleeve disposed in the flow control sub, the sleeve having a first end, a second end, and a first and second retractable lug disposed proximate the sleeve second end; and a guiding channel having at least three interconnected endpoints, the channel disposed in an inner cylindrical surface of the flow control sub, wherein one of the endpoints is uniquely associated with the second bore of the flow control sub and one of the endpoints is uniquely associated with the third bore; wherein the first and second retractable lugs are disposed in the guiding channel. Other embodiments of a system for controlling fluid flow in multilateral wellbore completions may generally include a primary wellbore tubular; a secondary wellbore tubular; a flow control sub having a first bore at a first end and a second and third bore at a second end, the first bore being in fluid communication with the second and third bores, one of the second or third bores being in fluid communication with the primary wellbore tubular and the other of the second or third bores being in fluid communication with the secondary wellbore tubular; a sleeve disposed in the flow control sub, the sleeve having a first end, a second end, and a first and second retractable lug disposed proximate the sleeve second end; and a guiding channel having at least two interconnected endpoints, the channel disposed in an inner cylindrical surface of the flow control sub, wherein one of the endpoints is uniquely associated with one of the second and third bores of the flow control sub; wherein the first and second retractable lugs are disposed in the guiding channel.

For any of the foregoing embodiments, the flow control system may include any one of the following elements, alone or in combination with each other:

A first and second channel in the inner wall of the single bore, and a first protrusion is disposed in the first channel and a second protrusion is disposed in the second channel.

A first portion of the sleeve is disposed in an additional sub coupled to and in fluid communication with the main body.

A second portion of the sleeve is sealingly disposed in one of the two adjacent through bores of the main body second section.

The guide channel has two different, spaced apart endpoints, where the first endpoint is associated with one of the two adjacent through bores of the main body second section and the second endpoint is associated with the other of the two adjacent through bores of the main body second section.

The guide channel has a third endpoint and the first, second and third endpoints are joined together by a plurality of segments forming the guide channel.

A portion of the guide channel has a depth that is different than another portion of the guide channel, and the protrusion on the sleeve are extendable.

The two adjacent through bores are parallel to each other.

An additional sub having a bore, coupled to the main body, and in fluid communication with the main body single bore, wherein the main body is characterized by a first axial length and the additional sub is characterized by a second axial length, wherein the second axial length of the additional sub is greater than the first axial length of the main body and a seal engages the inner cylindrical surface of the additional sub.

The guiding channel has a first depth and a portion of the guiding channel has a second depth deeper than the first depth, the deeper second portion positioned at an intersection of two guiding channel segments.

The sleeve further comprises a first seal sealingly engaging a cylindrical surface of one of the second and third bores of the flow control sub second end when the first and second retractable lugs are adjacent an endpoint, wherein the flow control sub further comprises a second seal sealingly engaging the cylindrical surface of the flow control sub first bore and sealingly engaging the sleeve, the sleeve extending through an aperture formed in the seal.

The main body comprises a first and second channel in the inner surface of the single bore, and a first protrusion is disposed in the first channel and a second protrusion is disposed in the second channel.

The protrusions are extendable.

The sleeve first end is disposed in an additional sub coupled to and in fluid communication with main body.

The sleeve second end is sealingly disposed in one of the two through bores of the main body second end.

The channel has two different, spaced apart endpoints, where the first endpoint is associated with the first bore of the main body dual bore and the second endpoint is associated with the second bore of the main body dual bore.

The channel has a third endpoint and the first, second and third endpoints are joined together by a plurality of segments forming the channel.

A portion of the channel has a depth that is different than another portion of the channel.

A seal disposed along the outer sleeve wall between the protrusion and the first end.

A seal disposed along the inner main body surface, the seal having an aperture.

A seal disposed along the outer sleeve wall between the protrusion and the second end.

An additional sub coupled to and in fluid communication with the main body first end, the additional sub having an inner cylindrical surface; wherein the main body is characterized by a first length between its two ends and the additional sub is characterized by a second length between its two ends, wherein the second length of the additional sub is greater than the first length of the main body; wherein the seal engages the inner cylindrical surface of the additional sub.

An additional sub coupled to and in fluid communication with the main body first end, the additional sub having an inner cylindrical surface; wherein the main body is characterized by a first length between its two ends and the additional sub is characterized by a second length between its two ends, wherein the second length of the additional sub is less than the first length of the main body; wherein the seal engages the inner cylindrical surface of the additional sub.

The channel is formed in an annular sleeve, and the annular sleeve is disposed in the main body sub.

The channel is formed in an annular sleeve, and the annular sleeve is disposed in the additional sub.

The channel is formed in an annular sleeve, a portion of the annular sleeve is disposed in the additional sub and a portion of the annular sleeve is disposed in the main body sub.

The channel comprises a plurality of segments having varying lengths, angles of intercept, and depths.

The channel has a first depth and a portion of the channel has a second depth deeper than the first depth, the deeper second portion positioned at an intersection of two channel segments.

An additional sub coupled to and in fluid communication with the main body first end, the additional sub having an inner cylindrical surface; wherein the main body is characterized by a first length between its two ends and the additional sub is characterized by a second length between its two ends, wherein the second length of the additional sub is greater than the first length of the main body; wherein an additional seal engages the inner cylindrical surface of the additional sub and the outer sleeve wall of the sleeve.

The channel comprises one segment between the first and second endpoints.

The guiding channel has a first depth and a portion of the guiding channel has a second depth deeper than the first depth, the deeper second portion positioned at an intersection of two channel segments.

The sleeve further comprises a first seal disposed at the sleeve second end sealingly engaging a cylindrical surface of one of the second and third bores of the flow control sub second end when the first and second retractable lugs are adjacent an endpoint, wherein the flow control sub further comprises a second seal disposed proximate flow control sub first end and sealingly engaging the cylindrical surface of the flow control sub first bore and sealingly engaging the sleeve, the sleeve extending through an aperture formed in the seal.

The sleeve first end is disposed in an additional sub coupled to and in fluid communication with the flow control sub.

The guiding channel has a third endpoint and the first, second and third endpoints are joined together by a plurality of segments forming the guiding channel.

An additional sub coupled to and in fluid communication with the flow control sub first end, the additional sub having an inner cylindrical surface; wherein the flow control sub is characterized by a first length between its two ends and the additional sub is characterized by a second length between its two ends, wherein the second length of the additional sub is greater than the first length of the flow control sub; wherein the seal engages the inner cylindrical surface of the additional sub.

An additional sub coupled to and in fluid communication with the flow control sub first end, the additional sub having an inner cylindrical surface; wherein the flow control sub is characterized by a first length between its two ends and the additional sub is characterized by a second length between its two ends, wherein the second length of the additional sub is less than the first length of the flow control sub; wherein a seal engages the inner cylindrical surface of the additional sub.

The guiding channel is formed in an annular sleeve, and the annular sleeve is disposed in the flow control sub.

The guiding channel is formed in an annular sleeve, and the annular sleeve is disposed in the additional sub.

The guiding channel is formed in an annular sleeve, a portion of the annular sleeve is disposed in the additional sub and a portion of the annular sleeve is disposed in the flow control sub.

The guiding channel comprises a plurality of segments having varying lengths, angles of intercept, and depths.

An additional sub coupled to and in fluid communication with the flow control sub first end, the additional sub having an inner cylindrical surface; wherein the flow control sub is characterized by a first length between its two ends and the additional sub is characterized by a second length between its two ends, wherein the second length of the additional sub is greater than the first length of the flow control sub; wherein a seal engages the inner cylindrical surface of the additional sub and the outer sleeve wall of the sleeve.

The guiding channel comprises one segment between the first and second endpoints.

A method for controlling flow in multilateral well completions has been described. The method may generally include positioning a flow control sub in a multilateral well where a first bore of the flow control sub is in fluid communication with a primary wellbore and second bore is in fluid communication with a secondary wellbore, applying a force to a sleeve having a through bore and disposed in the flow control sub in a first position, moving protrusions disposed on the sleeve along channels disposed in an inner wall of the flow control sub, moving the sleeve from the first position to a second position in the flow control sub, and placing the sleeve in fluid communication with at least one of the first and second bores of the flow control sub. Other embodiments of a method for controlling flow in multilateral well completions may generally include positioning a flow control sub in a multilateral well where a first bore of the flow control sub is in fluid communication with a primary wellbore and second bore is in fluid communication with a secondary wellbore, applying a force to a sleeve disposed in the flow control sub in a first position, moving protrusions disposed on an outer surface of the sleeve along channels disposed in an inner surface of the flow control sub, moving the sleeve from the first position to a second position in the flow control sub, and placing the sleeve in fluid communication with at least one of the first and second bores of the flow control sub. Other embodiments of a method for controlling flow in multilateral well completions may generally include a method for controlling flow in multilateral well completions may generally include moving protrusions disposed on an outer surface of a sleeve along channels disposed in an inner surface of a flow control sub, the sleeve being disposed in the flow control sub in a first position, moving the sleeve from the first position to a second position in the flow control sub, and placing the sleeve in fluid communication with at least one of a first bore of the flow control sub in fluid communication with a primary wellbore and second bore in fluid communication with a secondary wellbore.

For the foregoing embodiments, the method may include any one of the following steps, alone or in combination with each other:

The applying a force step comprises at least one of: pulling the sleeve, pushing the sleeve, and allowing gravity to impact the sleeve.

Providing at least one seal between the sleeve and the flow control sub.

Controlling movement of the protrusions within the channels by deepening a portion of the channels at an intersection of channel segments, extending the protrusions radially outward into the deeper portion of the channels, and moving the protrusions along the deeper channel portion and passing intersecting channel segments.

Positioning a flow control sub in a multilateral well comprises placing the sleeve in fluid communication with one of the first and second bores of the fluid control sub.

The sleeve is in the first or second position, flow through one of the first and second bores of the flow control sub is in upstream fluid communication, while flow through the other of the first and second bores of the flow control sub is isolated from upstream fluid communication.

Moving the sleeve to a third position in the flow control sub, and allowing flow through the first and second bore of the flow control sub to mingle in the flow control sub.

The positioning a flow control sub in a multilateral well comprises placing the sleeve in fluid communication with both the first and second bores of the fluid control sub.

The applying a force step comprises at least one of: pulling the sleeve, pushing the sleeve, and allowing gravity to impact the sleeve.

Providing at least one seal between the sleeve and the flow control sub.

Controlling movement of the extendable protrusions within the channels by deepening a portion of the channels at an intersection of channel segments; extending the extendable protrusions radially outward into the deeper portion of the channels; and moving the extendable protrusions along the deeper channel portion and passing intersecting channel segments.

The positioning a flow control sub in a multilateral well step comprises placing the sleeve is in fluid communication with one of the first and second bores of the fluid control sub.

The sleeve, when in the first or second position, places flow through one of the first and second bores of the flow control sub in upstream fluid communication, while isolating flow through the other of the first and second bores of the flow control sub from upstream fluid communication.

When the sleeve is in the first or second position, flow through one of the first and second bores of the flow control sub is in upstream fluid communication, while flow through the other of the first and second bores of the flow control sub is isolated from upstream fluid communication Moving the sleeve to a third position in the flow control sub; and allowing flow through the first and second bore of the flow control sub to mingle in the flow control sub.

Moving the sleeve to a third position in the flow control sub; and placing the sleeve in fluid communication with flow both the first and second bores of the flow control sub.

Placing flow through the first and second bores of the flow control sub in upstream fluid communication.

The positioning of a flow control sub in a multilateral well step comprises placing the sleeve in fluid communication with both the first and second bores of the fluid control sub.

Moving the sleeve in a transverse motion.

Moving the sleeve in an upward motion.

Increasing the force to move protrusions along an inclined portion of the channels.

Increasing the force to move protrusions in a transverse motion along the channels.

Moving the protrusions axially along a segment of the channels.

Decreasing the force to move protrusions along an inclined portion of the channels.

Isolating flow through one of the first and second bores of the flow control sub from upstream fluid communication.

Placing an additional sub in fluid communication with the flow control sub, and moving the protrusions along channels disposed in an inner surface of the additional sub.

Sealingly disposing a sleeve end in one of the first and second bores of the flow control sub.

Sealingly disposing the sleeve in the flow control sub.

Deepening a portion of the channels at an intersection of channels; extending the protrusions radially outward into the deeper portion of the channels; and moving the protrusions along the deeper channel portion and passing intersecting channel segments.

Moving the extendable protrusions along a deeper portion of the channels past an intersection of channel segments.

The moving protrusions step comprises applying a force of at least one of: pulling the sleeve, pushing the sleeve, and allowing gravity to impact the sleeve.

Providing at least one seal between the sleeve and the flow control sub.

Controlling movement of the protrusions within the channels by deepening a portion of the channels at an intersection of channel segments; extending the protrusions radially outward into the deeper portion of the channels; and moving the protrusions along the deeper channel portion and passing intersecting channel segments.

Placing the sleeve in fluid communication with one of the first and second bores of the fluid control sub.

When the sleeve is in the first or second position, flow through one of the first and second bores of the flow control sub is in upstream fluid communication, while flow through the other of the first and second bores of the flow control sub is isolated from upstream fluid communication.

Moving the sleeve to a third position in the flow control sub; and allowing flow through the first and second bore of the flow control sub to mingle in the flow control sub.

Placing the sleeve in fluid communication with both the first and second bores of the fluid control sub.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents, and alternatives falling within the spirit and scope of the disclosure as defined by the appended claims.

The invention claimed is:

1. A flow control assembly for oil and gas wells, the flow control assembly comprising:

a main body sub, having a first section with a single bore, and a second section with two adjacent through bores in fluid communication with the single bore of the first section;

a first guide channel and a second guide channel along an inner wall of the single bore; and a sleeve having a through bore is movably positionable in the main body with a first protrusion on the sleeve riding in the first guide channel and a second protrusion on the sleeve riding in the second guide channel to guide reciprocating movement of the sleeve within the main body.

2. The flow control assembly of claim 1, wherein a first portion of the sleeve is disposed in an additional sub coupled to and in fluid communication with the main body.

3. The flow control assembly of claim 1, wherein a second portion of the sleeve is sealingly disposed in one of the two adjacent through bores of the main body second section.

4. The flow control assembly of claim 1, wherein the first guide channel has two different, spaced apart endpoints, where the first endpoint is proximate one of the two adjacent through bores of the main body second section and the second endpoint is proximate the other of the two adjacent through bores of the main body second section.

5. The flow control assembly of claim 4, wherein the first guide channel has a third endpoint and the first, second and third endpoints are joined together by a plurality of segments forming the first guide channel.

6. The flow control assembly of claim 5, wherein a portion of the first guide channel has a depth that is different than another portion of the first guide channel, and the first protrusion on the sleeve are extendable.

7. The flow control assembly of claim 1, wherein the two adjacent through bores are parallel to each other.

8. The flow control assembly of claim 7, further comprising:

an additional sub having a bore, coupled to the main body, and in fluid communication with the main body single bore;

wherein the main body is characterized by a first axial length and the additional sub is characterized by a second axial length, wherein the second axial length of the additional sub is greater than the first axial length of the main body and a seal engages the inner cylindrical surface of the additional sub.

9. A system for controlling fluid flow in multilateral wellbore completions, the system comprising:

a flow control sub having a first bore in a first section in fluid communication with a second and third bore in a second section;

a primary wellbore tubular in fluid communication with one of the second and third bores;

a secondary wellbore tubular in fluid communication with the other of the second and third bores;

a sleeve having a through bore disposed in the flow control sub, the sleeve having a first and second retractable lug; and a guiding channel having at least three interconnected endpoints, the channel disposed in an inner wall of the flow control sub;

wherein the first and second retractable lugs are disposed in the guiding channel.

10. The system of claim 9, wherein the guiding channel has a first depth and a portion of the guiding channel has a second depth deeper than the first depth, the deeper second portion positioned at an intersection of two guiding channel segments.

11. The system of claim 10, wherein the sleeve further comprises a first seal sealingly engaging a cylindrical surface of one of the second and third bores of the flow control sub second end when the first and second retractable lugs are adjacent one of the endpoints, wherein the flow control sub further comprises a second seal sealingly engaging the cylindrical surface of the flow control sub first bore and sealingly engaging the sleeve, the sleeve extending through an aperture formed in the seal.

12. A method for controlling flow in multilateral well completions, the method comprising:

positioning a flow control sub in a multilateral well where a first bore of the flow control sub is in fluid communication with a primary wellbore and second bore is in fluid communication with a secondary wellbore;

applying a force to a sleeve having a through bore and disposed in the flow control sub in a first position;

moving protrusions disposed on the sleeve along channels disposed in an inner wall of the flow control sub;

moving the sleeve from the first position to a second position in the flow control sub;

placing the sleeve in fluid communication with at least one of the first and second bores of the flow control sub; and providing at least one seal between the sleeve and the flow control sub.

13. The method of claim 12, wherein the applying a force step comprises at least one of: pulling the sleeve, pushing the sleeve, and allowing gravity to impact the sleeve.

14. The method of claim 13, further comprising:

controlling movement of the protrusions within the channels by deepening a portion of the channels at an intersection of channel segments;

extending the protrusions radially outward into the deeper portion of the channels; and moving the protrusions along the deeper channel portion and passing intersecting channel segments.

15. The method of claim 14, wherein the positioning a flow control sub in a multilateral well comprises placing the sleeve in fluid communication with one of the first and second bores of the flow control sub.

16. The method of claim 15, wherein when the sleeve is in the first or second position, flow through one of the first and second bores of the flow control sub is in upstream fluid communication, while flow through the other of the first and second bores of the flow control sub is isolated from upstream fluid communication.

17. The method of claim 16, further comprising:

moving the sleeve to a third position in the flow control sub; and allowing flow through the first and second bore of the flow control sub to mingle in the flow control sub.

18. The method of claim 14, wherein the positioning a flow control sub in a multilateral well comprises placing the sleeve in fluid communication with both the first and second bores of the flow control sub.

* * * * *